US005173045A

United States Patent [19]

Macri

[11] Patent Number: 5,173,045

[45] Date of Patent: Dec. 22, 1992

[54] RADIAL SEAL FOR ROTARY COMBUSTOR

[75] Inventor: Cornel Macri, Monrovia, Calif.

[73] Assignee: Westinghouse Electric Corp., Pittsburgh, Pa.

[21] Appl. No.: 766,931

[22] Filed: Sep. 27, 1991

[51] Int. Cl.[5] ..... F27B 7/24

[52] U.S. Cl. ..... 432/115; 432/116; 277/148

[58] Field of Search ..... 432/116, 115, 242; 34/242; 277/148; 110/246

[56] References Cited

U.S. PATENT DOCUMENTS 4,728,289 3/1988 Samera, Jr. ..... 432/115
4,836,560 6/1989 Haberberger ..... 432/115
4,961,588 10/1990 Brienza ..... 432/115
4,972,786 11/1990 Blasiole ..... 110/246

*Primary Examiner*—Henry C. Yuen
*Attorney, Agent, or Firm*—G. H. Telfer

[57] ABSTRACT

A radial seal for a rotary combustor of a municipal solid waste incinerator disposed between compartments of a windbox having a ring disposed girthwise on the rotary combustor with a flat surface disposed normal to the axis of the rotary combustor and a plurality of bent thin plates attached to the windbox and bent to from a surface which engages the flat surface on the ring to form a running seal therebetween, which allows for differential thermal expansion between the rotary combustor and the windbox and allows for runout.

7 Claims, 3 Drawing Sheets

RADIAL SEAL FOR ROTARY COMBUSTOR

BACKGROUND OF THE INVENTION

The invention relates to a radial seal and more particularly to a radial combustion air seal for a rotary combustor in a municipal solid waste incinerator.

The rotary combustor of a municipal solid waste incinerator is made of a circular array of cooling pipes spaced apart by a perforated web. The combustor is inclined so the municipal solid waste which enters the upper end of the rotary combustor tumbles down during combustion and exits the lower end as the combustor rotates. Combustion air is supplied to the ignited waste through the perforated web in varying amounts from a divided windbox as the burning waste tumbles to the lower end of the combustor. Since the amount of combustion air supplied from each portion of the wind box varies depending on the waste being burned, accurate control of the combustion air in each portion of the windbox requires reliable radial seals between the various portions of the windbox.

SUMMARY OF THE INVENTION

Among the objects of the invention may be noted the provision of a radial seal, which is easily built without welding or machining, which can be easily replaced, which allows for differential thermal expansion of the combustor and the windbox, which allows for runout of the rotary combustor, and which does not interfere with axial seals as are normally used between the under and over fired portions of the windbox.

In general, a radial seal for a rotary combustor is formed on the exterior of a circular array of water cooled spaced apart pipes (which may also be referred to as "tubes") having a perforated web disposed between adjacent pipes. The rotary combustor is disposed on an inclined axis within a windbox, the upper portion of which is spaced a relatively short distance from the pipes. When made in accordance with this invention, the radial seal comprises a ring extending girth wise around the combustor and the ring has a flat surface normal to the axis of the rotary combustor. A plurality of thin bent plates depend from the upper portion of the windbox and are disposed adjacent each other. The lower portion of the windbox has a wall portion generally normal to the axis of the rotary combustor and a rim spaced from the rotary combustor. A plurality of thin bent plates extend from the rim. All of the thin bent plates have a distal margin disposed adjacent the pipes. A plurality of kerfs extend inwardly from the distal margin and there is a portion near the distal margin engaging the flat surface on the ring to form a running seal, which allows for differential thermal expansion of the windbox and the rotary combustor and for runout of the rotary combustor.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
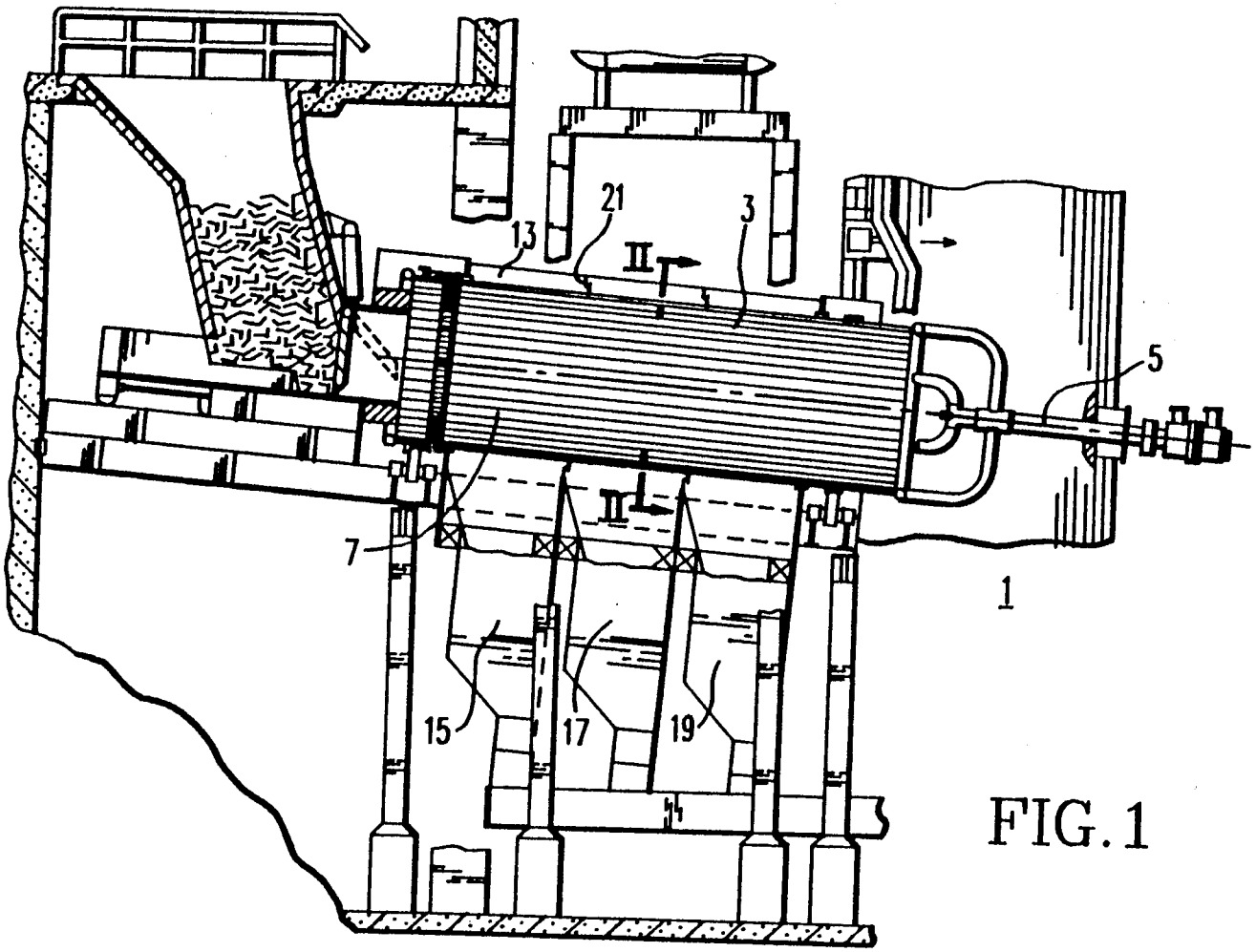
FIG. 1 is a partial sectional view of a municipal solid waste incinerator showing a rotary combustor and a windbox.

Referring now to the drawings in detail and in particular to FIG. 1 there is shown a portion of a municipal solid waste incinerator 1 having a rotary combustor 3 disposed for rotation on a inclined axis 5. The rotary combustor 3 comprises a circular array of spaced apart cooling pipes 7 having a perforated web 9 disposed between adjacent pipes 7. The greater portion of the rotary combustor 3 is disposed in a windbox 13. The windbox 13 is divided into three compartments, an inlet compartment 15 adjacent the inlet end of the rotary combustor 3, an intermediate compartment 17 disposed to encompass the central portion of the rotary combustor 3, and an outlet portion 19 disposed adjacent the outlet end of the rotary combustor 3. The compartments are each further divided into an underfire and overfire portions, whereby the combustion air to each portion of the rotary combustor 3 can be varied depending on the type of waste being introduced to the rotary combustor 3. To provide adequate control of the combustion air, effective radial seals 21 between the compartments 15, 17 and 19 are required.

Figure 2:
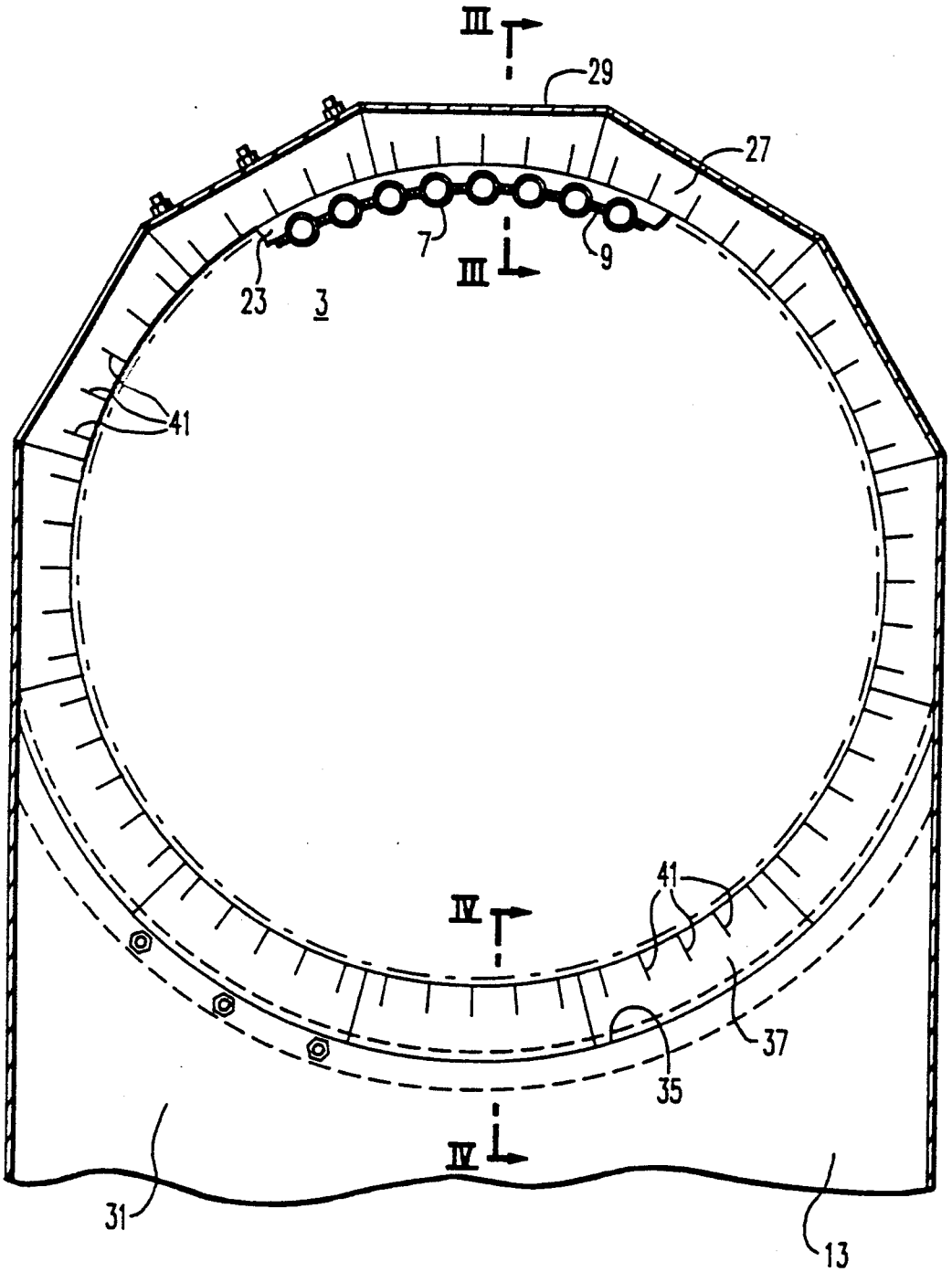
FIG. 2 is an enlarged sectional view taken on line II—II of FIG. 1.
Figure 3:
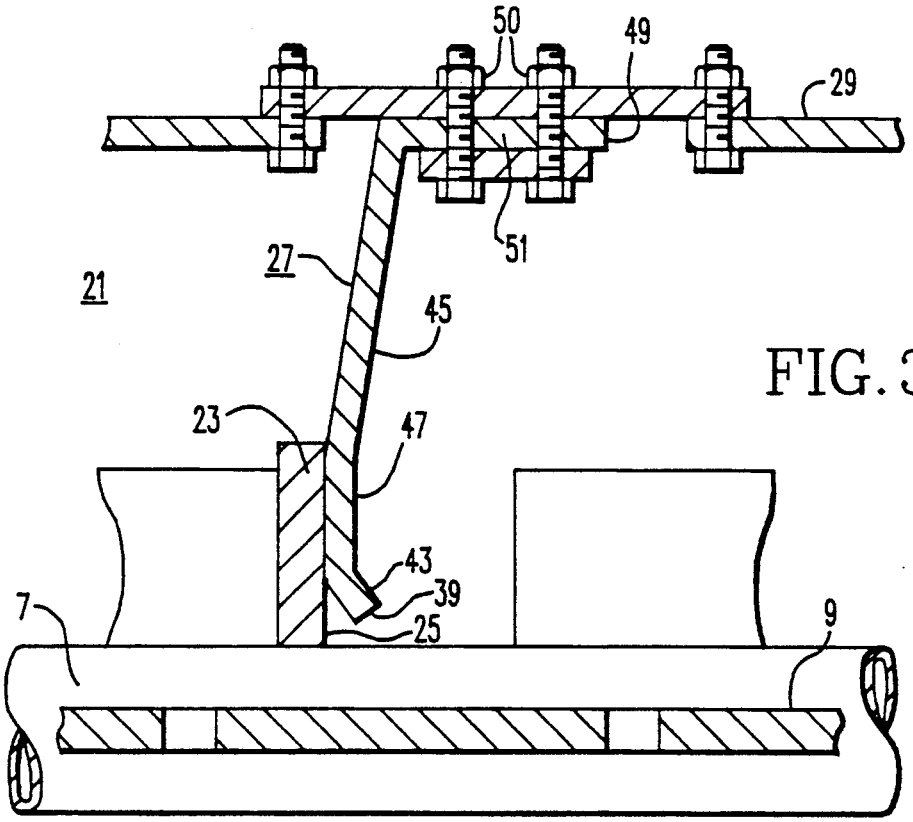
FIG. 3 is an enlarged sectional view taken on line III—III of FIG. 2.
Figure 4:
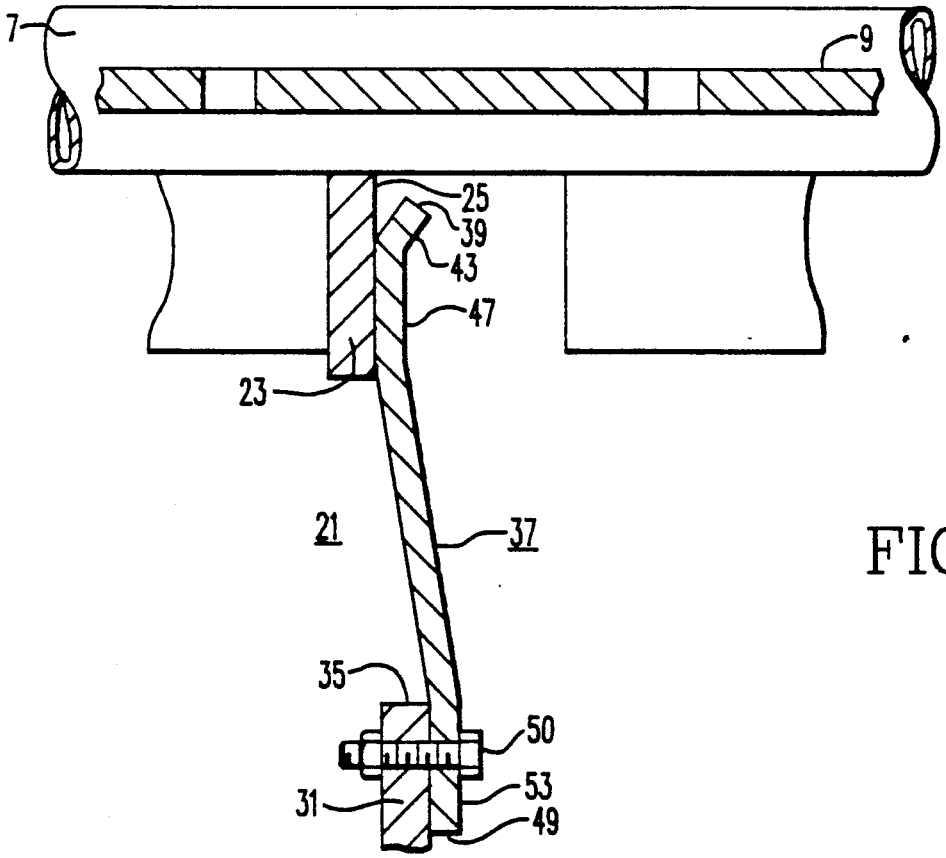
FIG. 4 is an enlarged sectional view taken on line IV—IV of FIG. 2.

As shown in FIGS. 2, 3 and 4, the radial seals 21 comprise a ring 23 extending girthwise around the rotary combustor 3 and having a flat surface 25 disposed normal to the axis of the rotary combustor 3. A plurality of thin bent plates 27 depend from an upper portion 29 of the windbox 13, which is preferably made in the shape of a dodecagon. The bent plates 27 are disposed adjacent each other enclosing one half or more of the annulus between the upper portion 29 of the windbox 13 and the rotary combustor 3. The lower portion of the windbox 13 has wall portions 31 separating the compartments 15, 17 and 19. The wall portions 31 have a rim 35 spaced from the rotary combustor 3 and a plurality of thin bent plates 37 extending from the rim 35. All of the thin bent plates 27 and 37 have a distal margin 39 disposed adjacent the rotary combustor 3, a plurality of kerfs 41 extending inwardly from the distal margin 39. Perspective short portions 43 of the thin bent plates 27 and 37, adjacent the distal margin, are bent away from the ring 23, and respective portions 45 outboard or and spaced from the short bent portions 43 are also bent away from the ring 23. The bent portions 43 and 45 cooperate to define an intermediate flat portion 47 smaller in radial dimension than the flat surface 25 on the ring 23. The flat portion 47 is disposed to engage the flat surface 25 on the ring 23 to form a running seal. The bent plates 27 and 37 are also bent along a line parallel to proximal margins 49 disposed opposite the distal margins 39 to form bent portions 51 and 53, respectively. These bends are less than 90°. The bent plates 27 and 37 are removably attached to the windbox 13 by bolts or other fastening means 50, which extend respectively through the bent portions 51 or 53 adjacent the proximal margins 49 and through the adjacent portion of the windbox 13.

The radial seals 21 described herein advantageously provide running seals, which are easily built without welding or machining, can be easily replaced, allow for differential thermal expansion of the rotary combustor 3 and the windbox 13, allow for runout and out of roundness of the rotary combustor 13 and do not interfere With the axial seals between the underfired and overfired combustion air portions of the windbox 13.

What is claimed is:

1. A radial seal for a rotary combustor formed by a circular array of water cooled spaced apart pipes having a perforated web disposed between adjacent pipes, the combustor being disposed for rotation on an inclined axis within a windbox, the upper portion of which is spaced a relatively short distance,.from said pipes, said radial seal comprising a ring extending girth wise around the rotary combustor and having a flat surface disposed normal to the axis of the rotary combustor and a plurality of thin bent plates depending from the upper portion of the windbox and disposed adjacent each other; the lower portion of the windbox having a wall portion generally normal to the axis of the rotary combustor and said wall having a rim spaced from the rotary combustor; a plurality of thin bent plates extending from said wall portion adjacent said rim; all of said thin bent plates having a distal margin disposed adjacent the pipes, a plurality of kerfs extending inwardly, from the distal margin of each thin bent plate and a portion of each thin bent plate adjacent the distal margin engaging the flat surface on the ring to form a running seal, which allows for differential thermal expansion of the windbox and the rotary combustor and runout of the rotary combustor.

2. The radial seal of claim 1, wherein the bent plates each have a short portion adjacent the distal margin bent in a direction away from the ring.

3. The radial seal claim 2, wherein the bent plates each have a portion outboard of the short portion bent in a direction away from the ring.

4. The radial seal of claim 3, wherein the bend adjacent the distal margin and the bend outboard cooperate to form a flat portion generally parallel to the flat surface on the ring and the bent plates being so disposed that the flat portion on the bent plate engages the flat surface on the ring.

5. The radial seal of claim 4, wherein the bent plate is bent along a line parallel to a proximal margin opposite the distal margin.

6. The radial seal cf claim 5, wherein the bend along the line parallel the proximal margin is less than 90°.

7. The radial seal of claim 6, wherein the bent plate is attached to the windbox by fasteners extending through the bent portion adjacent the proximal margin.

* * * * *